US009682458B2

(12) United States Patent
Jing

(10) Patent No.: US 9,682,458 B2
(45) Date of Patent: Jun. 20, 2017

(54) METHOD AND DEVICE FOR CONTROLLING GRINDING OF FLEXIBLE SUBSTRATE

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventor: Yangkun Jing, Beijing (CN)

(73) Assignees: BOE TECHNOLOGY GROUP CO., LTD. (CN); HEFEI BOE OPTOELECTRONICS TECHNOLOGY CO., LTD. (CN)

( * ) Notice: Subject to any disclaimer, the term of this patent is extended or adjusted under 35 U.S.C. 154(b) by 0 days.

(21) Appl. No.: 14/744,159

(22) Filed: Jun. 19, 2015

(65) Prior Publication Data

US 2016/0271751 A1 Sep. 22, 2016

(30) Foreign Application Priority Data

Mar. 18, 2015 (CN) ..... 2015 1 0119719

(51) Int. Cl.
*B24B 37/013* (2012.01)
*B24B 49/04* (2006.01)
(Continued)

(52) U.S. Cl.
CPC ..... *B24B 49/12* (2013.01); *B24B 37/005* (2013.01); *B24B 37/013* (2013.01); *B24B 49/04* (2013.01)

(58) Field of Classification Search
CPC ..... B24B 37/005; B24B 37/013; B24B 49/00; B24B 49/02; B24B 49/04; B24B 49/12
(Continued)

(56) References Cited

U.S. PATENT DOCUMENTS 5,643,050 A * 7/1997 Chen ..... B24B 37/015 451/10
5,899,792 A * 5/1999 Yagi ..... B24B 37/013 257/E21.23
(Continued)

FOREIGN PATENT DOCUMENTS

CN 103676244 A 3/2014
IT WO 2009013231 A1 * 1/2009 ..... B24B 7/228
(Continued)

OTHER PUBLICATIONS

Office Action in Chinese Patent Application No. 201510119719.1, dated Aug. 19, 2016.

*Primary Examiner* — Eileen Morgan
(74) *Attorney, Agent, or Firm* — Brooks Kushman P.C.

(57) ABSTRACT

The present disclosure relates to a technical field of manufacturing a display device, and more particular to a method and a device for controlling a grinding of a flexible substrate. The method includes: grinding an etching side of the flexible substrate; irradiating the flexible substrate with infrared rays or near infrared rays, receiving waves reflected by a side opposite to the grinding side and waves reflected by the grinding side of the flexible substrate respectively, and calculating a distance between the two sides based on the reflected waves; comparing the distance with a predetermined thickness of the flexible substrate in real time, and controlling an extent of grinding by a grinding device based on a difference of the distance from the grinding side to the side opposite to the grinding side of the flexible substrate and the predetermined thickness of the flexible substrate.

11 Claims, 2 Drawing Sheets

(51) Int. Cl.
*B24B 49/12* (2006.01)
*B24B 37/005* (2012.01)

(58) Field of Classification Search
USPC ..... 451/5, 6, 8, 10, 11
See application file for complete search history.

(56) References Cited

U.S. PATENT DOCUMENTS 6,074,287 A * 6/2000 Miyaji ..... B24B 49/12 451/287
6,656,755 B1 * 12/2003 Ohkawa ..... B24B 37/013 257/E21.567
7,601,615 B2 * 10/2009 Hayashi ..... B24B 7/228 257/E21.237
2003/0020909 A1 * 1/2003 Adams ..... G01J 3/28 356/326
2005/0191858 A1 * 9/2005 Fukunaga ..... B24B 37/013 438/691
2009/0305021 A1 * 12/2009 Ohkubo ..... G01B 11/0625 428/220
2011/0130073 A1 * 6/2011 Furukawa ..... B24B 37/042 451/6
2013/0033698 A1 * 2/2013 Fujimori ..... G01B 11/0625 356/51
2015/0065010 A1 * 3/2015 Miura ..... B24B 49/12 451/11
2016/0163597 A1 * 6/2016 Yamashita ..... H01L 21/78 438/462

FOREIGN PATENT DOCUMENTS

JP 2009-233809 A 10/2009
JP 2012-189507 A 10/2012
WO 2014/185008 A1 11/2014

* cited by examiner

METHOD AND DEVICE FOR CONTROLLING GRINDING OF FLEXIBLE SUBSTRATE

CROSS REFERENCE OF RELATED APPLICATION

The present application claims the priority of Chinese patent application No. 201510119719.1 filed on Mar. 18, 2015, the disclosure of which is incorporated herein by reference.

TECHNICAL FIELD

The present application relates to a technical field of manufacturing a display device, and more particular to a method and a device for controlling a grinding of a flexible substrate.

BACKGROUND

With customers' higher demand for quality of electronic products, thickness of a flexible panel is developed to be thinner and thinner. With the development of smart phones and tablet computers, display screens are required to be lighter and thinner. Due to the limitations of the manufacturing, it is difficult to make the thickness of a glass substrate to be further thinner. Thus, it is focused on thinning down the thickness of the liquid crystal panel or the flexible panel after the alignment fitting or packaging of the panel to obtain a further thinner and lighter panel. In contrast to the liquid crystal panel, it is more difficult to thinning down the flexible panel, because during the process of thinning down the flexible panel, it is common to protect a reserved detection electrode on the flexible device by: covering a reserved detection hole of the reserved electrode on the panel with protection glue before etching, and removing such protection glue after the etching. However, such removing may reduce the precision of the grinding, and thus cause the device to be damaged.

Conventionally, it is difficult to totally remove the protection glue after the etching during the process of thinning down the flexible panel, which leads to that even tiny particulates of residual protection glue may severely reduce the measurement precision and cause the misjudgment of the quality of the flexible device, because the current detection of the flexible device is in a magnitude of nanoampere, and the demand of the precision of measurement is high. Furthermore, such misjudgment may affect the determination of the parameters for the preceding manufacturing process and the stability of the whole manufacturing process.

In the prior art, there are generally two types of grinding:

1. contact grinding: an end of a contact point contacts the flexible substrate, and the other end of the contract point contacts the reference point, so as to obtain the thickness of the whole flexible substrate;

2. non-contact grinding: the thickness of the whole flexible substrate is measured by a non-contacted optical sensor. Wherein, a key point lies in measuring the thickness between the etching side and a front side of the metal layer of the flexible substrate.

The distance from a bottom of the reserved conductive electrode to the etching side of the flexible substrate may be calculated based on the thickness measurement in the above two methods. However, in the non-contact grinding of the prior art, the substrate is measured directly by the light which is made only once, and then a grinding device is controlled to grind the panel to a desired thickness based on the measurement result, which may lead to the thickness of the panel to be in a significant deviation.

SUMMARY

In the present disclosure, it is provided a method and a device for controlling a grinding of a flexible substrate for improving precision of the grinding.

In the present disclosure, it is provided a method for controlling a grinding of a flexible substrate including:

grinding an etching side of the flexible substrate;

irradiating the flexible substrate with infrared rays or near infrared rays, receiving waves reflected by a side opposite to the grinding side and waves reflected by the grinding side of the flexible substrate respectively, and calculating a distance from the grinding side to the side opposite to the grinding side of the flexible substrate based on the received waves reflected by the side opposite to the grinding side and the received waves reflected by the grinding side of the flexible substrate;

comparing the distance from the grinding side to the side opposite to the grinding side of the flexible substrate with a predetermined thickness of the flexible substrate; and controlling an extent of grinding by a grinding device based on a difference of the distance from the grinding side to the side opposite to the grinding side of the flexible substrate and the predetermined thickness of the flexible substrate.

In the above technical solution, the grinding side and the side (bottom side) opposite to the grinding side of the flexible substrate are irradiated with the infrared rays or the near infrared rays, so as to obtain the distance between the grinding side and the bottom side after each grinding in real time, and the extent of grinding by the grinding device may be adjusted based on the grinding condition which is determined by the difference between the obtained distance and a predetermined distance. As a result, the accuracy for grinding the flexible substrate is effectively improved. Thus, the precision of grinding the flexible substrate is improved.

Alternatively, the step of irradiating the flexible substrate with infrared rays or near infrared rays includes irradiating the flexible substrate by the infrared rays or the near infrared waves of the near infrared rays emitted by an infrared sensor.

Alternatively, the step of irradiating the flexible substrate with infrared rays or near infrared rays, receiving waves reflected by the side opposite to the grinding side and waves reflected by the grinding side of the flexible substrate respectively, and calculating a distance from the grinding side to the side opposite to the grinding side of the flexible substrate based on the received waves reflected by the side opposite to the grinding side and the received waves reflected by the grinding side of the flexible substrate includes:

emitting the infrared rays or the near infrared rays with different wavelength and same light intensity by each of the plurality of sub light sources at each non-overlapping time sequences;

collecting infrared images formed by the infrared rays or the near infrared rays with the different wavelengths reflected by the flexible substrate at different timings;

accumulating the light intensity of each pixel in the infrared image collected regarding the different wavelength to obtain an overall light intensity of the image; and comparing the overall light intensities obtained regarding different wavelengths with each other, and calculating the distance from the grinding side to the side opposite to the grinding side of the flexible substrate based on the maximum value of the differences of any two of the overall light intensities. As a result, information of an accurate distance may be obtained.

Alternatively, the step of collecting of an infrared image formed by the infrared rays or the near infrared rays with the different wavelengths reflected by the flexible substrate at different timings includes:

filtering the received light rays reflected by the grinding side and the side opposite to the grinding side of the flexible substrate to remove all other rays except the infrared rays or the near infrared rays, and collecting the filtered rays to form the infrared image.

As a result, the precision of the detection is improved, and the interference is prevented.

Alternatively, after collecting infrared images formed by the infrared rays or the near infrared rays with the different wavelengths reflected by the flexible substrate at different timings, parameters for signal processing is calculated by a function of a location of the infrared sensor based on characteristics of the grinding side, and a distortion of the collected infrared wave beams is corrected.

As a result, the precision of the detection is improved.

Alternatively, before irradiating the flexible substrate, receiving waves reflected by the side opposite to the grinding side and waves reflected by the grinding side respectively, and calculating a distance from the grinding side to the side opposite to the grinding side of the flexible substrate based on the received waves reflected by the side opposite to the grinding side and the received waves reflected by the grinding side on the flexible substrate, air or water is injected onto the flexible substrate.

As a result, an affection of the precision of the detection by foreign matters on the grinding side is prevented.

In the present disclosure, it is provided a flexible substrate grinding device including:

a grinding plate, configured to grind the flexible substrate;

a driving device, configured to drive the grinding plate to grinding, ascending and descending.

an infrared sensor, configured to emit infrared lights or near infrared lights for irradiating a grinding side and a side opposite to the grinding side of the flexible substrate; and a control device, configured to receive waves reflected by the side opposite to the grinding side and waves reflected by the grinding side of the flexible substrate respectively, and calculate a distance from the grinding side to the side opposite to the grinding side of the flexible substrate based on the received waves reflected by the side opposite to the grinding side and the received waves reflected by the grinding side of the flexible substrate, wherein the control device is further configured to compare the distance from the grinding side to the side opposite to the grinding side of the flexible substrate with a predetermined thickness of the flexible substrate in real time; and control an extent of grinding by the grinding plate based on a difference of the distance from the grinding side to the side opposite to the grinding side of the flexible substrate and the predetermined thickness of the flexible substrate.

In the above embodiment, the distance between the grinding side and the side opposite to the grinding side of the flexible substrate is monitored by the infrared sensor in real time, and the control device controls the grinding of the grinding side of the flexible substrate by the grinding device based on the difference between the distance and a predetermined thickness of the flexible substrate. As a result, the precision control of the grinding of the flexible substrate is effectively improved, and the quality of the side after being ground is better.

Alternatively, the infrared sensor includes a plurality of sub light sources, the plurality of sub light sources emit the infrared rays or the near infrared rays with different wavelengths and same light intensity at non-overlapping time sequences.

Alternatively, the control device collects infrared images formed by the infrared rays or the near infrared rays with the different wavelengths reflected by the flexible substrate at different times; accumulates the light intensity of each pixel in the infrared image collected regarding the different wavelength to obtain an overall light intensity of the image; and compares the overall light intensities obtained regarding different wavelengths with each other, and calculating the distance from the grinding side to the side opposite to the grinding side of the flexible substrate based on the maximum value of the differences of any two of the overall light intensities.

Alternatively, the control device filters the received light rays reflected by the grinding side and the side opposite to the grinding side of the flexible substrate to remove all other rays except the infrared rays or the near infrared rays, and collects the filtered rays to form the infrared images.

Alternatively, after collecting infrared images formed by the infrared rays or the near infrared rays with the different wavelengths reflected by the flexible substrate at different times, the control device calculates parameters for signal processing by a function of a location of the infrared sensor based on characteristics of the grinding side, and corrects a distortion of the collected infrared wave beams.

Alternatively, a horizontal guide rail is arranged on a base of the grinding device, and a vertical guide rail is glidingly arranged on the horizontal guide rail, wherein the infrared sensor is glidingly arranged on the vertical guide rail.

Alternatively, the flexible substrate grinding device further includes an air injection device or a deionized water injection device arranged on the infrared sensor.

As a result, the precision of the detection by the infrared sensor is improved.

Alternatively, the infrared sensor includes an infrared emitting and receiving circuit, a signal amplifying and filtering circuit configured to be connected to the infrared emitting and receiving circuit, and a data processor configured to be connected to the signal amplifying and filtering circuit.

As a result, the interference of the signal is prevented, and the readiness of extracting the signal is improved.

Alternatively, the flexible substrate grinding device further includes a display unit configured to be connected to the signal of the control device, and display an infrared image formed by the infrared rays or the near infrared rays with the different wavelengths reflected by the flexible substrate. The image detected by the infrared sensor is displayed by a display device.

DETAILED DESCRIPTION

In the embodiment of the present disclosure, it is provided a method and a device for grinding a flexible substrate for improving the precision of the grinding of the flexible substrate. In this method, a distance between a grinding side and a side opposite to the grinding side of the flexible substrate may be obtained in real time by irradiating the flexible substrate with infrared rays or a near infrared rays, and a grinding of a grinding device may be controlled based on a difference between the distance and a grinding distance, so that the precision of the grinding is improved. In the following, the present disclosure will be further explained in details in the embodiment for further clarifying the objects, the technical solutions and the advantages of the present disclosure.

According to an embodiment of the present disclosure, it is provided a method for controlling a grinding of a flexible substrate including:

grinding an etching side of the flexible substrate;

irradiating the flexible substrate with infrared rays or near infrared rays, receiving waves reflected by a side opposite to the grinding side and waves reflected by the grinding side of the flexible substrate respectively, and calculating a distance from the grinding side to the side opposite to the grinding side of the flexible substrate based on the received waves reflected by the side opposite to the grinding side and the received waves reflected by the grinding side of the flexible substrate;

comparing the distance from the grinding side to the side opposite to the grinding side of the flexible substrate with a predetermined thickness of the flexible substrate; and controlling an extent of grinding by a grinding device based on a difference of the distance from the grinding side to the side opposite to the grinding side of the flexible substrate and the predetermined thickness of the flexible substrate.

In the above embodiment, the grinding side and the side (bottom side) opposite to the grinding side of the flexible substrate are irradiated with the infrared rays or the near infrared rays, so as to obtain the distance between the grinding side and the bottom side after each grinding in real time, and the extent of grinding by the grinding device may be adjusted based on the grinding condition which is determined by the difference between the obtained distance and a predetermined distance. As a result, the accuracy for grinding the flexible substrate is effectively improved. Thus, the precision of grinding the flexible substrate is improved.

Figure 1:
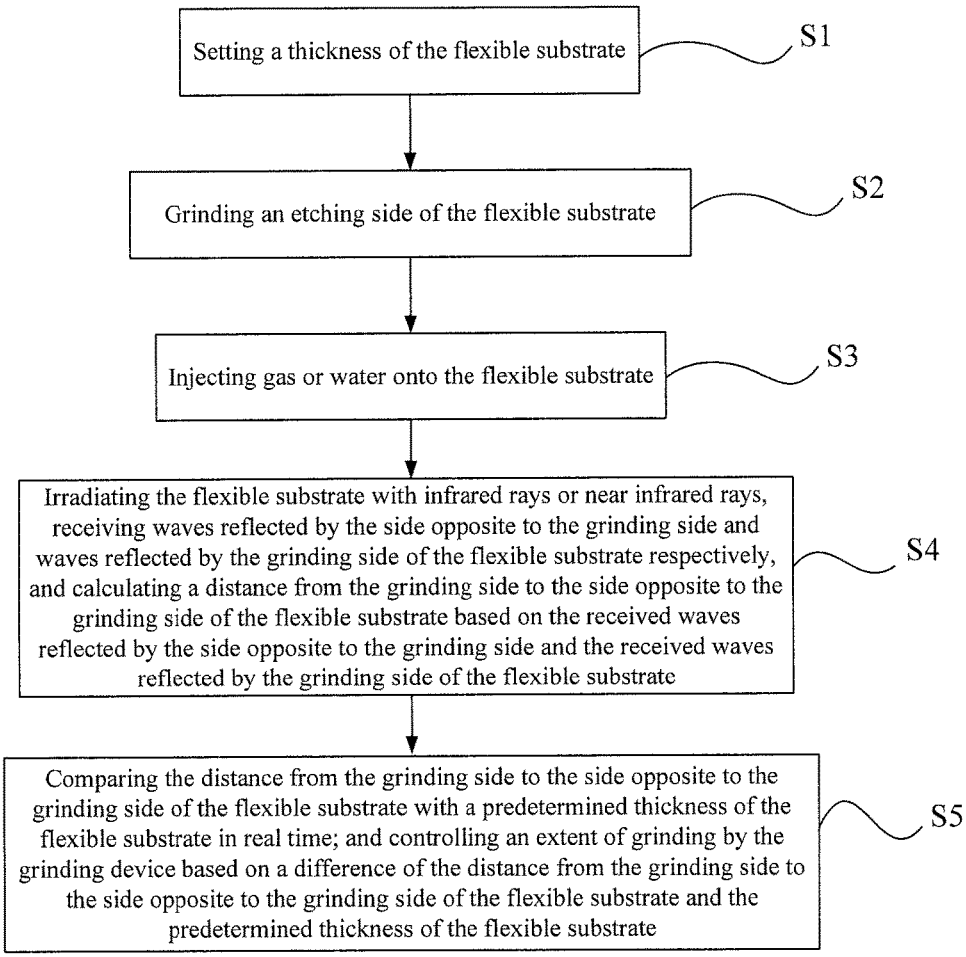
FIG. 1 illustrates a flow chart of a method for controlling a grinding of a flexible substrate according to an embodiment of the present disclosure.

As illustrated in FIG. 1, it is a flow chart of the method for controlling the grinding of the flexible substrate according to the embodiment of the present disclosure. In the following, the flexible substrate grinding method will be explained in details associated with FIG. 1 and the specific embodiment to facilitate the understanding of the flexible substrate grinding method of the present embodiment.

Step S1: setting a thickness of the flexible substrate.

Specifically, the thickness of the flexible substrate after being ground is determined based on a size of the flexible substrate to be ground, wherein the thickness of the flexible substrate is a distance between a grinding side and a side opposite to the grinding side of the flexible substrate after being ground.

Step S2: grinding an etching side of the flexible substrate.

Step S3: injecting gas or water onto the flexible substrate.

Step S4: irradiating the flexible substrate with infrared rays or near infrared rays, receiving waves reflected by the side opposite to the grinding side and waves reflected by the grinding side of the flexible substrate respectively, and calculating a distance from the grinding side to the side opposite to the grinding side of the flexible substrate based on the received waves reflected by the side opposite to the grinding side and the received waves reflected by the grinding side of the flexible substrate.

Specifically, the grinding side and the bottom side of the flexible substrate are irradiated with the infrared rays or the near infrared rays emitted by the infrared sensor.

Wherein the method further includes: before irradiating, calibrating the infrared sensor, and determining a standard location of the infrared sensor on the grinding device and fixing the infrared sensor on the standard location.

The infrared sensor includes a plurality of sub light sources. In this embodiment, the number of the sub light sources may be two, i.e. a first sub source and a second sub source. Each of the wavelengths of the emitted infrared rays may be greater than 680 nm and less than 1050 nm, and both the first sub source and the second sub source may be infrared light emitting diodes. It should be noted that, the more the number of the sub light sources emitting the infrared rays with different wavelengths, the infrared rays whose respective colors affect the transmissibility of the infrared rays least among the infrared rays may be found easier upon detecting with different colors.

Obtaining the distance specifically includes:

A. the plurality of sub light sources emitting the infrared rays or the near infrared rays with different wavelengths and same light intensity at non-overlapping time sequences, and the grinding side and the bottom side of the flexible substrate being irradiated with the infrared rays or the near infrared rays.

B. collecting infrared images formed by the infrared rays or the near infrared rays with the different wavelengths reflected by the flexible substrate at different timings.

Specifically, filtering the received light rays reflected by the grinding side and the side opposite to the grinding side of the flexible substrate to remove all other rays except the infrared rays or the near infrared rays, and collecting the filtered rays to form the infrared image. It should be noted that, in this embodiment, the first sub light source and the second sub light source emits the infrared rays at different timings, i.e. non-overlapping time sequences, and the infrared rays emitted by these two sub light sources may be differentiated based on the emitting timings.

Furthermore, in this embodiment, it further includes: after collecting the reflected infrared rays with different wavelengths, calculating parameters for signal processing with a function of the locations of the infrared wave detectors based on the characteristics of the grinding side, and correcting the distortion of the collected infrared wave beams.

C. accumulating the light intensity of each pixel in the infrared image collected regarding the different wavelength to obtain an overall light intensity of the image;

Specifically, upon obtaining the first infrared image and the second infrared image emitted by the first sub source and the second sub source, accumulates the light intensity of each pixel in the image to calculate the overall light intensity of the whole infrared image. The detecting range for the light intensity of the reflected infrared rays is effectively extended by accumulating the light intensity of each pixel in the whole image.

Furthermore, in the method of the present embodiment, the infrared rays are collected by an array of the infrared wave detectors. An array of the infrared wave detectors may function as both the emitter and the receiver, or two arrays of the infrared wave detectors may function as the emitter and the receiver respectively.

In this embodiment, besides calculating the distance between the thicknesses of the flexible substrates based on the total light intensity of the reflected infrared image, the defects of the surfaces of the substrate are detected by obtaining the surface characteristics of the flexible substrate by the infrared wave detectors.

D. comparing the overall light intensities obtained regarding different wavelengths with each other, and calculating the distance from the grinding side to the bottom side of the flexible substrate based on the maximum value of the differences of any two of the overall light intensities.

Step S5: comparing the distance from the grinding side to the side opposite to the grinding side of the flexible substrate with a predetermined thickness of the flexible substrate in real time; and controlling an extent of grinding by the grinding device based on a difference of the distance from the grinding side to the side opposite to the grinding side of the flexible substrate and the predetermined thickness of the flexible substrate.

Specifically, the extent of the grinding by the grinding device is controlled based on the difference between the distance from the grinding side to the side opposite to the grinding side of the flexible substrate obtained by monitoring in real time and the predetermined thickness of the flexible substrate; when the distance is greater than a first predetermined value of the extent of the grinding, the grinding device is controlled to make course grinding; when the difference between the distance and the extent of the grinding is less than the first predetermined value and greater than a second predetermined value, the grinding device is controlled to make finish grinding; and when the difference between the distance and the extent of the grinding is less than the second predetermined value and greater than a third predetermined value, the grinding device is controlled to make polishing. As a result, the flexible substrate may be ground precisely, and the precision of the grinding is improved.

The above method for measuring the thickness of the flexible substrate is based on the imaging of the reflection and the transmittance of the infrared rays, and the affection on the distance by the colors in the flexible substrate is reduced and the measurement precision is improved by emitting a plurality of infrared rays (at least two infrared rays).

In the flexible substrate grinding method of this embodiment, the flexible substrate is irradiated by the plurality of the infrared sub light sources with different wavelengths at different timings. For each ray with the identical wavelength, the infrared ray corresponding to the infrared image with the highest light intensity is selected for calculating the distance from the grinding side to the side opposite to the grinding side of the flexible substrate. As a result, the loss of the light intensity of the infrared rays caused by the affection of the colors of the flexible substrate during the transmission of the infrared rays is reduced, and thus the measurement precision is improved. Meanwhile, it facilitates the measurement of the thickness of the box, and the liquid crystal injection machine may be adjusted to control the thickness of the box in a better manner, and thus the quality of the displaying of the liquid crystal screen is improved.

Figure 2:
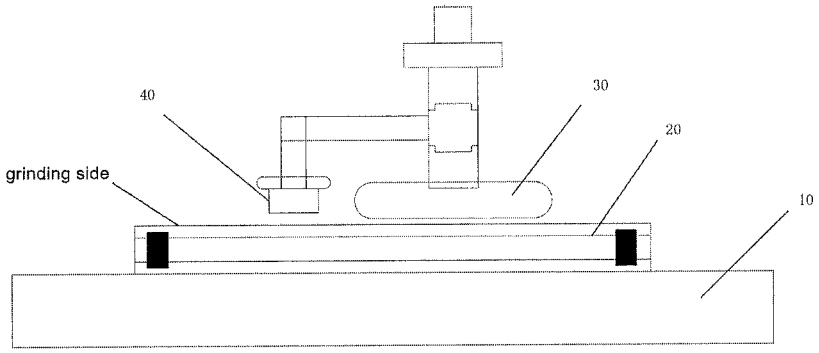
FIG. 2 illustrates a structural schematic view of a device for grinding a flexible substrate according to an embodiment of the present disclosure.

As illustrated in FIG. 2, it illustrates a structural schematic view of a device for grinding a flexible substrate according to an embodiment of the present disclosure.

In the present disclosure, it is further provided a flexible substrate grinding device including:

a grinding plate 30, configured to grind the flexible substrate 20;

a driving device, configured to drive the grinding plate 30 to grinding, ascending and descending.

an infrared sensor 40, configured to emit infrared lights or near infrared lights for irradiating a grinding side and a side opposite to the grinding side of the flexible substrate 20; and a control device, configured to receive waves reflected by the side opposite to the grinding side and waves reflected by the grinding side of the flexible substrate 20 respectively, and calculate a distance from the grinding side to the side opposite to the grinding side of the flexible substrate 20 based on the received waves reflected by the side opposite to the grinding side of the flexible substrate 20 and the received waves reflected by the grinding side of the flexible substrate 20; and compare the distance from the grinding side to the side opposite to the grinding side of the flexible substrate 20 with a predetermined thickness of the flexible substrate 20 in real time; and control an extent of grinding by the grinding plate 30 based on a difference of the distance from the grinding side to the side opposite to the grinding side of the flexible substrate 20 and the predetermined thickness of the flexible substrate 20.

In the above embodiment, as illustrated in FIG. 2, the flexible substrate 20 is arranged on the base 10, the distance between the grinding side and the side opposite to the grinding side of the flexible substrate 20 is monitored by the infrared sensor 40 in real time, and the control device controls the grinding of the grinding side of the flexible substrate 20 by the grinding plate 30 based on the difference between the distance and a predetermined thickness of the flexible substrate. As a result, the precision control of the grinding of the flexible substrate 20 is effectively improved, and the quality of the side after being ground is better.

Specifically, in this embodiment, the control device includes a light intensity accumulation unit and a comparison and calculation unit. Wherein, the comparison and calculation unit compares the total light intensity corresponding to each infrared image obtained by the calculation of the light intensity accumulation unit with each other, and calculates the distance from the grinding side to the side opposite to the grinding side of the flexible substrate 20 based on a rule that the light intensity is inversely proportional to the square of the transmission distance during the transmission of the infrared ray, i.e. the thickness of the flexible substrate in real time. In this embodiment, the comparison and calculation unit compares the light intensity corresponding to each image obtained by the light intensity accumulation unit. The light intensity corresponding to each image is determined based on the comparison of the intensities overlapped by a first image and a second image. The procedure of calculating the distance from the grinding side to the side opposite to the grinding side of the flexible substrate 20 based on the light intensity specifically includes: firstly, the equation for calculating the light vector is $E=A\cos[2\pi\gamma(t-x/v)+\phi]$, wherein A represents the amplitude, $\gamma$ represents light frequency, v represents the transmission speed of the light in the media, $\phi$ represents an initial phase, t represents the time, and x represents the distance during the time t; secondly, the equation for calculating the horizontal axis component of the light vector is $Ex=A\cos[2\pi\gamma(t-x/vx)+\phi]$, and the equation for calculating the longitudinal axis component of the light vector is $Ey=A\cos[2\pi\gamma(t-x/vy)+\phi]$, wherein since the phase difference $\Delta$ is obtained based on the horizontal distance vx and the longitudinal distance vy in case that the light transmits through a sample with a thickness of d wherein the equation for the phase difference is $\Delta=2\pi*(Nx-Ny)*d/\lambda$, wherein Nx−Ny equals $\Delta n$, i.e. $\Delta=2\pi*\Delta n*d/\lambda$, $\Delta n*d$ is called the retardation phase difference, which is the distance from the grinding side to the side opposite to the grinding side of the flexible substrate 20 to be obtained in this embodiment, and is a value varies in real time.

Alternatively, in this embodiment, it further includes a display device and a power supply, wherein the power supply is connected between the control device and the display device, and the display device is connected to the comparison and calculation unit and displays the distance from the grinding side to the side opposite to the grinding side of the flexible substrate 20 obtained by the comparison and calculation unit in real time.

During the operation, when the flexible substrate 20 is entered into an image capturing range of the infrared sensor 40, the infrared ray with a first wavelength having a high reflectivity relative to the flexible substrate 20 and the infrared ray with a second wavelength having a low reflectivity relative to the flexible substrate 20 are selected, and the infrared sensor 40 collects a first image formed by the infrared ray with the first wavelength reflected by the flexible substrate 20 and a second image formed by the infrared ray with the second wavelength reflected by the flexible substrate 20 respectively. The light intensity accumulation unit accumulates the light intensities of the first image and the second image, and then the comparison and calculation unit determines that the light intensity of the first image is much higher than the light intensity of the second image since the reflectivity of the infrared ray with the first wavelength relative to the flexible substrate 20 is relatively high. As a result, the comparison and calculation unit calculates the distance between the infrared sensor and the grinding side of the flexible substrate based on the intensities of the infrared ray with the first wavelength upon being emitted and being received. Accordingly, since the reflectivity of the infrared ray with the second wavelength relative to the flexible substrate 20 is relatively low, the comparison and calculation unit calculates the distance between the infrared sensor and the bottom side of the flexible substrate based on the intensities of the infrared ray with the second wavelength upon being emitted and being received, so that the distance between the grinding side and the bottom side of the flexible substrate may be obtained in real time.

In the specific embodiment, for reducing the computation load, the overall light intensities obtained regarding different wavelengths may be compared with each other, and the distance from the grinding side to the side opposite to the grinding side of the flexible substrate (i.e. the bottom side of the flexible substrate) may be calculated based on the maximum value of the differences of any two of the overall light intensities. Thus, the thickness of the flexible substrate may be directly calculated based on the differences of the intensities, the details of which are similar to the above method and omitted herein.

In the implementation, in order to improve the precision of the calculation, the light intensity of the infrared ray regarding common circumstance are stored in the comparison and calculation unit, and the light intensity of the image collected by the infrared sensor 40 equals to the light intensity obtained by the light intensity accumulation unit minus the light intensity of the infrared ray regarding the common circumstance. In the present disclosure, the infrared ray reflection and transmission imaging device irradiates the flexible substrate 20 with a plurality of infrared light sources with the different wavelengths at different timings. For an identical wavelength, the infrared ray corresponding to the image with highest light intensity is selected to calculate the distance from the grinding side to the side opposite to the grinding side of the flexible substrate 20. Thus, the affection on the measurement distance caused by the loss of the light intensity of the grinding side may be effectively reduced, and the precision of the measurement is improved.

In this embodiment, the infrared sensor 40 includes the array of the infrared wave detectors (sub light sources) which scan the thickness of the flexible substrate on the base substrate (the distance from the bottom side to the grinding side of the flexible substrate 20), and specifically obtain the two dimensional surface characteristics of the flexible substrate 20. Wherein the infrared sensor 40 includes an infrared emitting and receiving circuit, a signal amplifying and filtering circuit configured to be connected to the infrared emitting and receiving circuit, and a data processor configured to be connected to the signal amplifying and filtering circuit. Thus, based on the surface characteristics of the flexible substrate 20, the feedback signal can be obtained precisely, and the precision of the detection is improved. The parameters for signal processing may be calculated based on the function of the locations of the infrared wave detectors, and thus the distortion of the infrared wave beams caused by the reflected infrared wave pulses is corrected.

In a preferred embodiment, the flexible substrate 20 scans by each ultrasonic test (UT) detector of the array of the detectors with multi parts merely emitting each time and recording the received infrared wave form reflected by each part in the array, so that the complete data set may be applicable to the location of each detector of the independent group for emitting and receiving. The controllable array of the infrared wave forms is processed to measure the surface characteristics of the flexible substrate 20. Based on the surface characteristics obtained by measuring, the parameters for processing signal is calculated by the function of the locations of the detectors for correcting the uneven surface, and the distortion of the wave forms generated in the reflection signal of the reflector in the flexible substrate 20 is eliminated. The collection array for processing data changes the parameters for signal processing by using the function of the location of the encoded detector, so as to analyze the internal of the components based on the reflected signal from the internal of the flexible substrate 20.

In the preferred embodiment, a conventional Synthetic Aperture Focusing Technique (SAFT) is applicable to two dimensional apertures which are required for forming three dimensional point focusing, so that the sensitivity is enhanced and the degree of the precision is improved. It is relatively easy to apply the SAFT to the array emitting/focusing solution because all wave forms from each part are stored. Then, it is very easy to focus the wave forms from the locations of the plurality of detectors onto one point to obtain the effect of the SAFT.

In another embodiment, during the scanning of the flexible substrate 20, the two dimensional surface characteristics may be measured by a function of the encoded locations of the detectors by any technique among the mechanical embossing stylus technique, the laser based technique, the infrared wave technique, and etc. Based on the obtained surface characteristics by measuring, the parameters for signal processing are calculated based on the function of the locations of the detectors. These parameters for signal processing are configured to correct the uneven surface so that the distortion of the wave forms generated in the reflected signal is eliminated. Then, the calculated parameters for signal processing are downloaded into a commercial phase array device connected to a two dimensional infrared wave array transducer. Then, the flexible substrate 20 is scanned by an array infrared wave detectors with multi parts in an array based on the parameters for signal processing downloaded into the phase array device, so that the parameters for signal processing may be electronically selected based on the locations of the infrared wave detectors, and the pulses reflected by the reflector in flexible substrate 20 are received, processed and recorded by using these detectors.

In another embodiment, the flexible substrate 20 may be scanned by using the above method to measure the surface characteristics. During the scanning of the flexible substrate 20 to measure the surface characteristics, each of the infrared wave detectors with multi parts in the array emits once. The infrared wave form received from each part in the array is recorded, so that the complete data set of each of the emitting parts and each the receiving parts being uniquely combined regarding each of the locations of the detectors is recorded. The parameters for signal processing are calculated based on the above measured surface characteristics. Then, the data receiving array received based on the independent reflection of each part are processed by using the up-to-date calculated parameters for signal processing, so that the unevenness of the surface is corrected, and the distortion of the wave beams generated in the reflected signal from the reflector in the flexible substrate 20 is eliminated.

In the above embodiments, the single array of detectors may have the functions of the emitter and the receiver or use two array detectors with multi parts, wherein one of the two detectors is configured to be the emitter, and the other one of the two detectors is configured to be the receiver. Thus, two detectors are configured to be the emitter and the receiver respectively, so that the amplitude of the reflection of the interface between the liquid and the flexible substrate 20 is reduced, and thus the system is "blind" to the reflection of the near surface within the flexible substrate 20. The difference between the operation and computation of the parameters for signal processing using the two detectors and the operation and computation of the parameters for signal processing using the single combined emitter/receiver detector merely lies in considering the relative locations of the two detectors. In this case, while the infrared waves reflected from the internal of the flexible substrate 20 are received by the separated receiver detector, the emitter detector may be operated in a pulse/echo mode (the emitting and the receiving may be implemented by a single part in the detector) to obtain the information on the surface characteristics. Such two detectors are horizontally separated from each other. The emitter (first) detector emits the infrared wave pulses to the couple liquid and the internal of the flexible substrate 20, and receives the reflected infrared waves from the surface of the flexible substrate 20, so as to measure the surface characteristics of the flexible substrate 20. The receiver (second) detector receives the reflected infrared wave from the internal of the flexible substrate 20. Such data may be processed based on the data collecting and processing method of the present disclosure, so as to create the images having the infrared wave forms focused on various points within a region of interest. The data from various number of parts may also be processed to be applicable to various region of the flexible substrate 20 to effectively change the aperture. For example, the effective aperture may be increased with the increment of the focal distance, so that a constant focal width for an usage detection region is maintained since the equation for calculating the focal width is as follows:

focal width=focal length*infrared wavelength/effective detector width.

Thus, the surface characteristics of the flexible substrate may be precisely measured by using the infrared waves of the array detectors. While the flexible substrate 20 is scanned to electronically scan the wave beams in a predetermined angle, the reflection data of the infrared waves on the surface is collected. When it is determined that the precise characteristics of the partial surface have been created by the reflection data, the received data is combined by using the angles of the wave beams and the locations of the detectors being known. When the infrared wave beams are perpendicular to the surface, a maximum reflection from a point on the surface may be obtained. When the data of the various angles of the wave beams and the locations of the detectors is combined, the reflection with the highest amplitude from a given point on the surface is used for measuring the distance from the detector to this point on the surface. The location of the point on the surface may be determined based on the location of the detector and the angle of the wave beams being applicable to the maximum reflection. The characteristics of the whole surface may be obtained by defining the surface by measuring the grid point. For the array emitting collection data, a signal processing which is substantially equal to the above phase array processing may be implemented to provide a same function for obtaining the characteristic of the surface. For characterize the whole surface, the infrared wave beams may be scanned in a predetermined angel. During the collection, the obtained signal includes the information on the amplitude and the time of the signal of the angle peaks of various wave beams on each of the positions of the detectors.

In the above embodiment, the array infrared wave detectors with multi parts are used, so that the detectors in array is adopted for both accelerating the speed of scanning and implementing multiple angles to obtain the surface characteristics of the flexible substrate 20. Meanwhile, the defects of the surface and the internal of the flexible substrate 20 are detected based on the infrared images obtained by scanning with the infrared rays.

In the above embodiment, an air injection device or a deionized water injection device arranged on the infrared sensor 40 are further included for improving the accuracy of detecting the grinding side. Foreign matters on the grinding side are removed by the air injection device or the deionized water injection device, so as to obtain a precision location of the grinding side.

A horizontal guide rail is arranged on a base of the grinding device, and a vertical guide rail is glidingly arranged on the horizontal guide rail, wherein the infrared sensor 40 is glidingly arranged on the vertical guide rail. The infrared sensor 40 is coupled on the vertical guide rail, and the two ends of the vertical guide rails slides on the horizontal guide rail in the horizontal direction, so that the infrared sensor 40 may scan the flexible substrate 20 in all dimensions.

Alternatively, the driving device of the embodiment includes an electrical cylinder and a position sensor, wherein the electrical cylinder provide power for the movement of the vertical guide rail and the horizontal guide rail, and the position sensor detects a position of the vertical guide rail that moves on the horizontal guide rail. When the position sensor detects that the vertical guide rail moves to be outside of the edge of the flexible substrate along the horizontal guide rail, the position sensor may give a warning.

It is appreciated that those skilled in the art may modify and improve the present disclosure without departing from the spirit and principle of the present disclosure. As a result, if those modification and improvement falls within the scope of claims and the equivalence thereof, those modification and improvement fall within the scope of the present disclosure.

What is claimed is:

1. A method for controlling a grinding of a flexible substrate, comprising:

grinding an etching side of the flexible substrate;

irradiating the flexible substrate with infrared rays or near infrared waves of near infrared rays emitted by an infrared sensor, receiving waves reflected by a side opposite to the grinding side and waves reflected by the grinding side of the flexible substrate respectively, and calculating a distance from the grinding side to the side opposite to the grinding side of the flexible substrate based on the received waves reflected by the side opposite to the grinding side and the received waves reflected by the grinding side of the flexible substrate, wherein, emitting the infrared rays or the near infrared rays with different wavelengths and same light intensity at non-overlapping time sequences by a plurality of sub light sources of the infrared sensor; collecting infrared images formed by the infrared rays or the near infrared rays with the different wavelengths reflected by the flexible substrate at different timings; accumulating the light intensity of each pixel in the infrared image collected regarding the different wavelength to obtain an overall light intensity of the image; and comparing the overall light intensities obtained regarding different wavelengths with each other, and calculating the distance from the grinding side to the side opposite to the grinding side of the flexible substrate based on the maximum value of the differences of any two of the overall light intensities;

comparing the distance from the grinding side to the side opposite to the grinding side of the flexible substrate with a predetermined thickness of the flexible substrate, and controlling an extent of grinding by a grinding device based on a difference of the distance from the grinding side to the side opposite to the grinding side of the flexible substrate and the predetermined thickness of the flexible substrate.

2. The method according to claim 1, wherein the step of collecting infrared images formed by the infrared rays or the near infrared rays with the different wavelengths reflected by the flexible substrate at different timings comprises:

filtering the received light rays reflected by the grinding side and the side opposite to the grinding side of the flexible substrate to remove all other rays except the infrared rays or the near infrared rays, and collecting the filtered rays to form the infrared images.

3. The method according to claim 1, further comprising:

after collecting infrared images formed by the infrared rays or the near infrared rays with the different wavelengths reflected by the flexible substrate at different timings, calculating parameters for signal processing by a function of a location of the infrared sensor based on characteristics of the grinding side, and correcting a distortion of the collected infrared wave beams.

4. The method according to claim 1, further comprising:

air injecting or water injecting onto the flexible substrate before irradiating the flexible substrate, receiving waves reflected by the side opposite to the grinding side and waves reflected by the grinding side respectively, and calculating a distance from the grinding side to the side opposite to the grinding side of the flexible substrate based on the received waves reflected by the side opposite to the grinding side and the received waves reflected by the grinding side on the flexible substrate.

5. A flexible substrate grinding device, comprising:

a grinding plate, configured to grind the flexible substrate;

a driving device, configured to drive the grinding plate to grinding, ascending and descending;

an infrared sensor, configured to emit infrared lights or near infrared lights for irradiating a grinding side and a side opposite to the grinding side of the flexible substrate; and a control device, configured to receive waves reflected by the side opposite to the grinding side and waves reflected by the grinding side of the flexible substrate respectively, and calculate a distance from the grinding side to the side opposite to the grinding side of the flexible substrate based on the received waves reflected by the side opposite to the grinding side and the received waves reflected by the grinding side of the flexible substrate, wherein the control device is further configured to compare the distance from the grinding side to the side opposite to the grinding side of the flexible substrate with a predetermined thickness of the flexible substrate, and control an extent of grinding by a grinding plate based on a difference of the distance from the grinding side to the side opposite to the grinding side of the flexible substrate and the predetermined thickness of the flexible substrate; wherein the infrared sensor comprises a plurality of sub light sources, the plurality of sub light sources are configured to emit the infrared rays or the near infrared rays with different wavelengths and same light intensity at non-overlapping time sequences;

the control device is further configured to collect infrared images formed by the infrared rays or the near infrared rays with the different wavelengths reflected by the flexible substrate at different timings; accumulate the light intensity of each pixel in the infrared image collected regarding the different wavelength to obtain an overall light intensity of the image; and compare the overall light intensities obtained regarding different wavelengths with each other, and calculating the distance from the grinding side to the side opposite to the grinding side of the flexible substrate based on the maximum value of the differences of any two of the overall light intensities.

6. The flexible substrate grinding device according to claim 5, the control device is further configured to filter the received light rays reflected by the grinding side and the side opposite to the grinding side of the flexible substrate to remove all other rays except the infrared rays or the near infrared rays, and collect the filtered rays to form the infrared images.

7. The flexible substrate grinding device according to claim 5, after collecting infrared images formed by the infrared rays or the near infrared rays with the different wavelengths reflected by the flexible substrate at different timings, the control device is further configured to calculate parameters for signal processing by a function of a location of the infrared sensor based on characteristics of the grinding side, and correct a distortion of the collected infrared wave beams.

8. The flexible substrate grinding device according to claim 5, wherein a horizontal guide rail arranged on a base of the grinding device, and a vertical guide rail glidingly arranged on the horizontal guide rail, wherein the infrared sensor is glidingly arranged on the vertical guide rail.

9. The flexible substrate grinding device according to claim 5, further comprising an air injection device or a deionized water injection device arranged on the infrared sensor.

10. The flexible substrate grinding device according to claim 5, wherein the infrared sensor comprises an infrared emitting and receiving circuit, a signal amplifying and filtering circuit configured to be connected to the infrared emitting and receiving circuit, and a data processor configured to be connected to the signal amplifying and filtering circuit.

11. The flexible substrate grinding device according to claim 5, further comprising:

a display unit, configured to be connected to the signal of the control device, and display infrared images formed by the infrared rays or the near infrared rays with the different wavelengths reflected by the flexible substrate.

* * * * *